US009783906B2

(12) United States Patent
Mine

(10) Patent No.: US 9,783,906 B2
(45) Date of Patent: Oct. 10, 2017

(54) SUBSTRATE ELECTROLYTIC PROCESSING APPARATUS AND PADDLE FOR USE IN SUCH SUBSTRATE ELECTROLYTIC PROCESSING APPARATUS

(71) Applicant: Ebara Corporation, Tokyo (JP)

(72) Inventor: Junko Mine, Tokyo (JP)

(73) Assignee: Ebara Corporation, Tokyo (JP)

( * ) Notice: Subject to any disclaimer, the term of this patent is extended or adjusted under 35 U.S.C. 154(b) by 53 days.

(21) Appl. No.: 14/718,829

(22) Filed: May 21, 2015

(65) Prior Publication Data

US 2015/0368825 A1 Dec. 24, 2015

(30) Foreign Application Priority Data

May 26, 2014 (JP) ..... 2014-108331
Apr. 23, 2015 (JP) ..... 2015-088741

(51) Int. Cl.

| | |
|---|---|
| ***C25D 21/10*** | (2006.01) |
| ***C25D 17/00*** | (2006.01) |
| ***C25F 3/02*** | (2006.01) |
| ***C25F 7/00*** | (2006.01) |

(52) U.S. Cl.
CPC ..... *C25D 21/10* (2013.01); *C25D 17/00* (2013.01); *C25F 3/02* (2013.01); *C25F 7/00* (2013.01)

(58) Field of Classification Search
None
See application file for complete search history.

(56) References Cited

U.S. PATENT DOCUMENTS

| | | | | |
|---|---|---|---|---|
| 3,652,442 A * | 3/1972 | Powers | C25D 21/10 204/261 |
| 4,102,756 A * | 7/1978 | Castellani | C25D 3/562 204/239 |
| 5,516,412 A * | 5/1996 | Andricacos | C25D 17/00 204/224 M |
| 7,727,366 B2 * | 6/2010 | Keigler | C25D 21/12 204/297.01 |
| RE45,687 E * | 9/2015 | Saito | C25D 21/10 |

(Continued)

FOREIGN PATENT DOCUMENTS

| | | |
|---|---|---|
| JP | 2007-046154 | 2/2007 |
| JP | 2009-155726 | 7/2009 |

*Primary Examiner* — Harry D Wilkins, III
(74) *Attorney, Agent, or Firm* — Leydig, Voit & Mayer, Ltd.

(57) ABSTRACT

A substrate electrolytic processing apparatus capable of leveling an electric-field shielding rate with no need to increase its size is disclosed. The substrate electrolytic processing apparatus includes a processing bath for holding a processing solution, a substrate holder for holding a substrate and capable of locating the substrate in the processing bath, a counter electrode disposed in the processing bath and serving as an electrode opposite to the substrate, and a paddle disposed between the counter electrode and the substrate and configured to reciprocate parallel to a surface of the substrate so as to agitate the processing solution. The paddle includes agitation rods disposed in an inner region of the paddle and agitation rods disposed in an outer region of the paddle, and gaps between the agitation rods disposed in the outer region is smaller than gaps between the agitation rods disposed in the inner region.

5 Claims, 15 Drawing Sheets

(56) References Cited

U.S. PATENT DOCUMENTS

| | | | | |
|---|---|---|---|---|
| 2002/0108850 | A1* | 8/2002 | Sakaki | H01L 21/2885 204/232 |
| 2003/0168340 | A1* | 9/2003 | Kaja | C25D 17/007 205/96 |
| 2004/0245094 | A1* | 12/2004 | McHugh | C25D 17/001 204/253 |
| 2005/0006241 | A1* | 1/2005 | McHugh | C25D 17/008 205/80 |
| 2006/0113185 | A1* | 6/2006 | Kuriyama | C23C 18/1628 204/275.1 |
| 2007/0151844 | A1* | 7/2007 | Wilson | C25D 5/18 204/230.2 |
| 2009/0139871 | A1* | 6/2009 | Saito | C25D 21/10 205/148 |
| 2013/0334051 | A1* | 12/2013 | Chen | C25D 17/008 205/95 |

* cited by examiner c1>c2>c3>c4>c5

SUBSTRATE ELECTROLYTIC PROCESSING APPARATUS AND PADDLE FOR USE IN SUCH SUBSTRATE ELECTROLYTIC PROCESSING APPARATUS

CROSS REFERENCE TO RELATED APPLICATIONS

This document claims priorities to Japanese Patent Application Number 2014-108331 filed May 26, 2014 and Japanese Patent Application Number 2015-088741 filed Apr. 23, 2015, the entire contents of which are hereby incorporated by reference.

BACKGROUND

FIG. 16 is a schematic view showing a plating apparatus which is an example of a substrate electrolytic processing apparatus. As shown in FIG. 16, the plating apparatus includes a plating bath 101 for holding a plating solution therein, an anode 102 disposed in the plating bath 101, an anode holder 103 holding the anode 102, and a substrate holder 104. The substrate holder 104 is configured to detachably hold a substrate W, such as a wafer, and immerse the substrate W in the plating solution held in the plating bath 101. The anode 102 and the substrate W are disposed in a vertical position and opposite each other in the plating solution.

The plating apparatus further includes a paddle 105 for agitating the plating solution in the plating bath 101, and a regulation plate 106 for regulating a distribution of electric potential on the substrate W. The regulation plate 106 is disposed between the paddle 105 and the anode 102, and has an opening 106*a* for restricting an electric field, in the plating solution. The paddle 105 is located near a surface of the substrate W held by the substrate holder 104. The paddle 105 is disposed in a vertical position, and is configured to reciprocate parallel to the surface of the substrate W to thereby agitate the plating solution so that a sufficient amount of metal ions can be supplied uniformly to the surface of the substrate W during plating of the substrate W.

The anode 102 is coupled to a positive electrode of a power source 107 through the anode holder 103, and the substrate W is coupled to a negative electrode of the power source 107 through the substrate holder 104. When a voltage is applied between the anode 102 and the substrate W, an electric current is passed to the substrate W, so that a metal film is formed on the surface of the substrate W.

FIG. 17 is a view from arrow A shown in FIG. 16. In FIG. 17, the substrate holder 104 is not depicted. In FIG. 17, the substrate W has a diameter of 300 mm. A width of the paddle 105 is smaller than the diameter of the substrate W. The paddle 105 includes a plurality of agitation rods 108 extending in a vertical direction. The agitation rods 108 are arranged at equal intervals. Since the paddle 105 is located in the electric field between the anode 102 and the substrate W, the agitation rods 108 reciprocates from side to side as shown by arrows while shielding the substrate from the electric field.

FIG. 18 is a graph showing electric-field shielding rate. The electric-field shielding rate is a ratio of a time during which the paddle 105 shields the substrate from the electric field to a total time of the reciprocation of the paddle 105. A horizontal axis in FIG. 18 represents distance [mm] from a center of the substrate W and a vertical axis represents the electric-field shielding rate. A thick line shown in FIG. 18 represents mean value of the electric-field shielding rate. It can be seen from FIG. 18 that the electric-field shielding rate sharply drops in a region in which the distance from the center of the substrate W exceeds 100 mm. When the electric-field shielding rate decreases, an electric current density on the substrate W increases, and the metal film, formed on the substrate W, becomes thick. As shown in FIG. 18, the electric-field shielding rate at a peripheral portion of the substrate W is lower than the electric-field shielding rate at a central portion of the substrate W. Accordingly, the metal film at the peripheral portion of the substrate W is thicker than the metal film at the central portion of the substrate W. As a result, the thickness of the metal film formed on the substrate W becomes non-uniform.

If the width of the paddle 105 is made larger than the diameter of the substrate W, it is possible that the electric-field shielding rate is uniform. However, the plating bath 101 that houses the paddle 105 must be large, resulting in an increase in size of the entirety of the plating apparatus.

SUMMARY OF THE INVENTION

According to embodiments, there are provided a substrate electrolytic processing apparatus capable of leveling an electric-field shielding rate with no need to increase its size, and a paddle for use in such a substrate electrolytic processing apparatus.

The below-described embodiments relate to a paddle for use in processing (e.g., plating) of a surface of a substrate, such as a wafer, and to a substrate electrolytic processing apparatus provided with such a paddle.

In an embodiment, there is provided a substrate electrolytic processing apparatus comprising: a processing bath for holding a processing solution; a substrate holder for holding a substrate and capable of locating the substrate in the processing bath; a counter electrode disposed in the processing bath and serving as an electrode opposite to the substrate; and a paddle disposed between the counter electrode and the substrate and configured to reciprocate parallel to a surface of the substrate so as to agitate the processing solution, the paddle including agitation rods disposed in an inner region of the paddle and agitation rods disposed in an outer region of the paddle, and gaps between the agitation rods disposed in the outer region being smaller than gaps between the agitation rods disposed in the inner region.

In an embodiment, a central region is formed at a center of the paddle, and a gap between agitation rods disposed in the central region is smaller than the gaps between the agitation rods disposed in the inner region.

In an embodiment, an agitation rod is disposed on a central axis of the paddle.

In an embodiment, the gaps between the agitation rods disposed in the inner region are the same as each other.

In an embodiment, the gaps between the agitation rods disposed in the outer region are the same as each other.

In an embodiment, a numerical value, which is obtained by subtracting a half of a stroke length of the paddle from a half width of the paddle, is less than a radius of the substrate.

In an embodiment, the agitation rods are divided into a first group and a second group which is located outside the first group, and a distance between the second group and the surface of the substrate is smaller than a distance between the first group and the surface of the substrate.

In an embodiment, predetermined gaps are formed between the agitation rods, and the predetermined gaps gradually decrease with a distance from a central axis of the paddle.

In an embodiment, there is provided a paddle for agitating a plating solution by reciprocating parallel to a surface of a substrate, comprising: agitation rods extending in a vertical direction, the agitation rods including a central agitation rod and outer agitation rods which are symmetric with respect to the central agitation rod, wherein predetermined gaps are formed between the outer agitation rods, and the predetermined gaps gradually decrease with a distance from the central agitation rod.

In an embodiment, a numerical value, which is obtained by subtracting a half of a stroke length of the paddle from a half width of the paddle, is less than a radius of the substrate.

In an embodiment, the outer agitation rods are divided into a first group located at both sides of the central agitation rod and a second group located outside the first group, and a distance between the second group and the surface of the substrate is smaller than a distance between the first group and the surface of the substrate.

In an embodiment, there is provided a plating apparatus comprising: a plating bath for holding a plating solution; an anode disposed in the plating bath; a substrate holder for holding a substrate and capable of locating the substrate in the plating bath; and a paddle disposed between the anode and the substrate and configured to reciprocate parallel to a surface of the substrate so as to agitate the plating solution, the paddle comprising agitation rods extending in a vertical direction, the agitation rods including a central agitation rod and outer agitation rods which are symmetric with respect to the central agitation rod, wherein predetermined gaps are formed between the outer agitation rods, and the predetermined gaps gradually decrease with a distance from the central agitation rod.

In an embodiment, a numerical value, which is obtained by subtracting a half of a stroke length of the paddle from a half width of the paddle, is less than a radius of the substrate.

In an embodiment, the outer agitation rods are divided into a first group located at both sides of the central agitation rod and a second group located outside the first group, and a distance between the second group and the surface of the substrate is smaller than a distance between the first group and the surface of the substrate.

According to the embodiments described above, even if the paddle has a smaller width than a diameter of the substrate, the electric-field shielding rate can be uniform. Therefore, use of the paddle in plating of the substrate enables the formation of a metal film with uniform thickness on the substrate.

DESCRIPTION OF EMBODIMENTS

Figure 1:
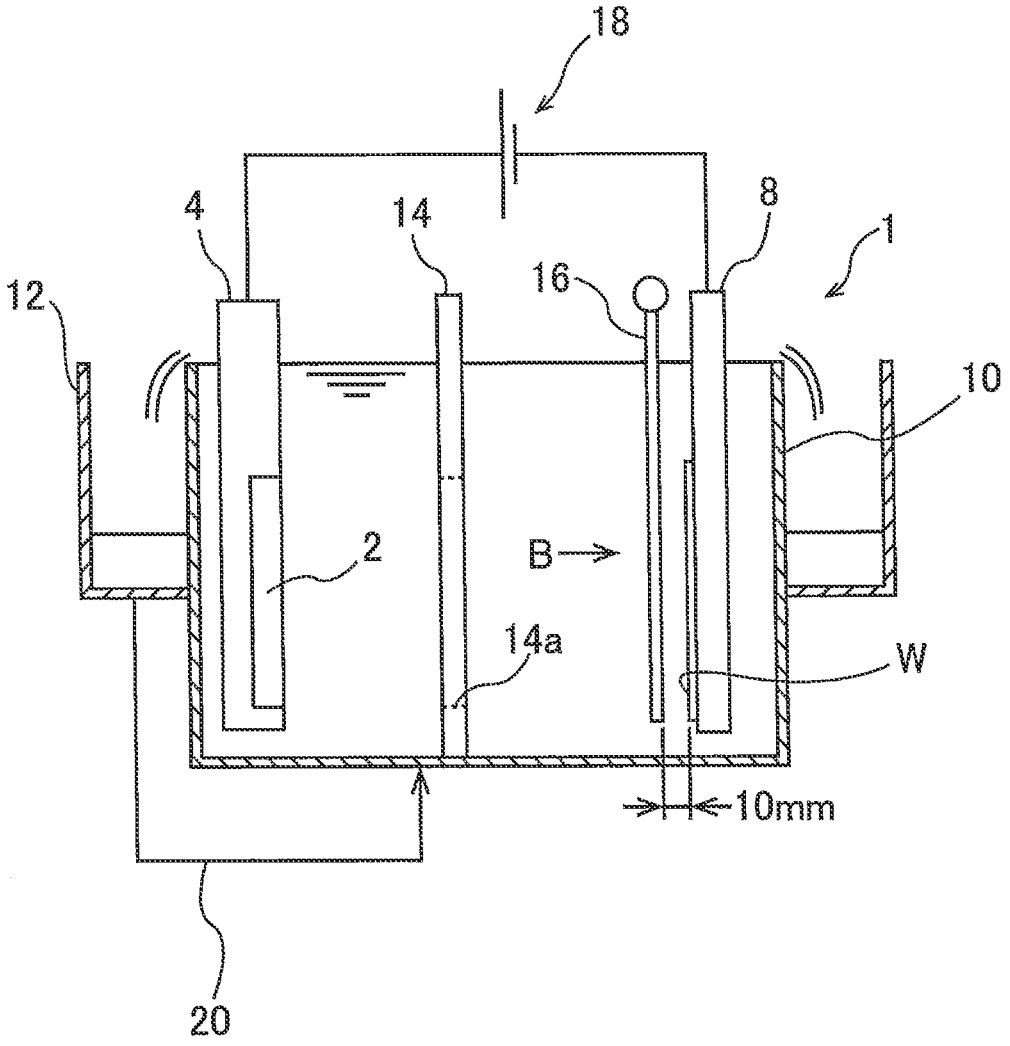
FIG. 1 is a schematic view showing a plating apparatus according to an embodiment.
Figure 2A:
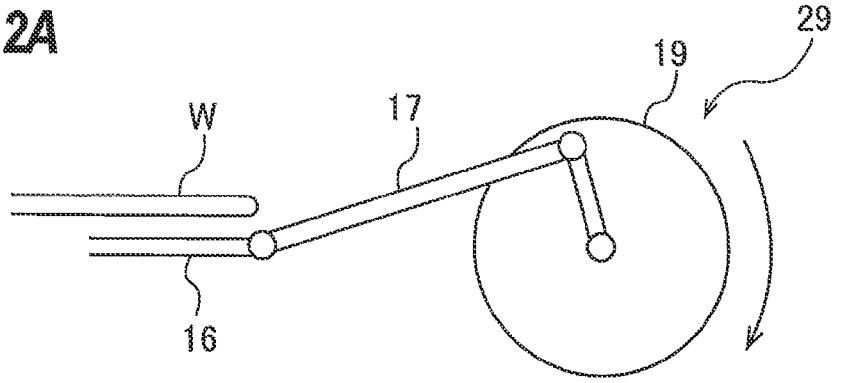
FIG. 2A, FIG. 2B, FIG. 2C, and FIG. 2D are schematic views each showing a reciprocation of a paddle.
Figure 2B:
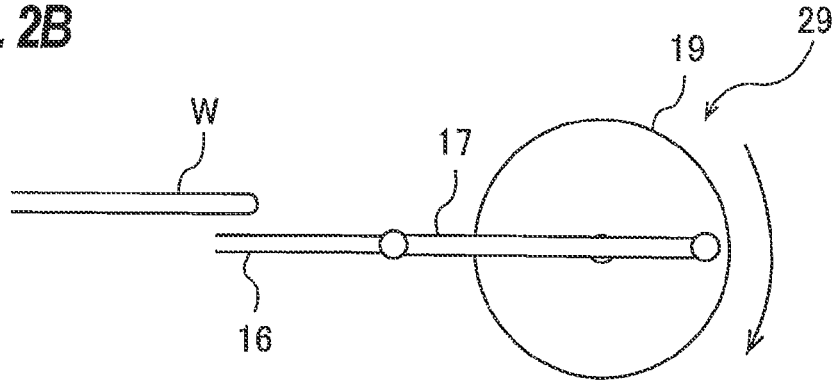
Figure 2C:
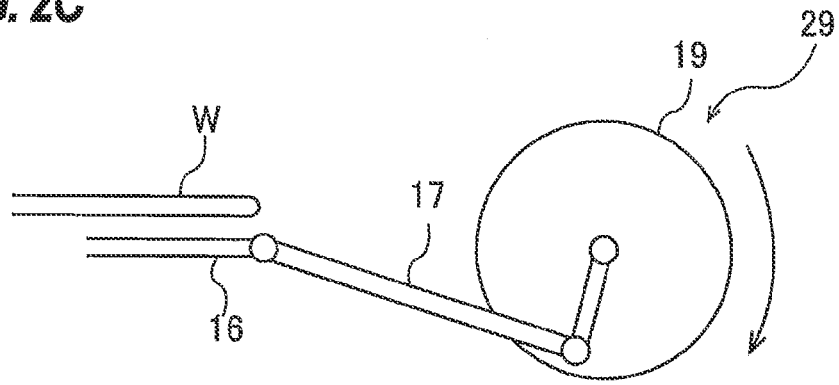
Figure 2D:
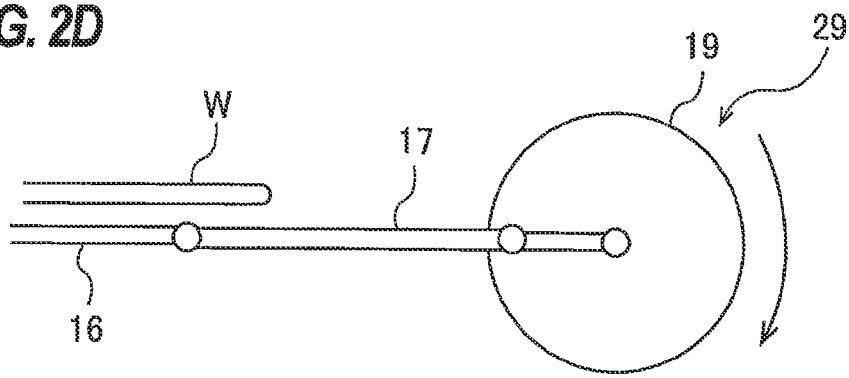

Embodiments will now be described with reference to the drawings. The same reference numerals are used in FIGS. 1 through 15 to refer to the same or corresponding elements, and duplicate descriptions thereof will be omitted.

A plating apparatus according to an embodiment, which is an example of a substrate electrolytic processing apparatus, will be described below. Other examples of the substrate electrolytic processing apparatus include an electrolytic etching apparatus. FIG. 1 is a schematic view showing a plating apparatus according to the embodiment. As shown in FIG. 1, the plating apparatus includes a plating bath (or a processing bath) 1 for holding a plating solution (or a processing solution) therein, an anode (or a counter electrode) 2 disposed in the plating bath 1, an anode holder 4 holding the anode 2, and a substrate holder 8. The substrate holder 8 is configured to detachably hold a substrate W, such as a wafer, and immerse the substrate W in the plating solution held in the plating bath 1.

The anode 2 and the substrate W are disposed in vertical positions, and opposite each other in the plating solution (i.e., to function as opposite poles). The anode 2 is coupled to a positive electrode of a power source 18 through the anode holder 4, and the substrate W is coupled to a negative electrode of the power source 18 through the substrate holder 8. When a voltage is applied between the anode 2 and the substrate W, an electric current is passed to the substrate W, so that a metal film is formed on the surface of the substrate W.

The plating bath 1 includes a plating solution storage bath 10 in which the substrate W and the anode 2 are disposed, and further includes an overflow bath 12 adjacent to the plating solution storage bath 10. The plating solution in the plating solution storage bath 10 overflows a side wall of the plating solution storage bath 10 into the overflow bath 12.

One end of a plating solution circulation line 20 is connected to a bottom of the overflow bath 12, and other end of the plating solution circulation line 20 is connected to a bottom of the plating solution storage bath 10. The plating solution overflows the side wall of the plating solution storage bath 10 into the overflow bath 12, and is returned from the overflow bath 12 to the plating solution storage bath 10 through the plating solution circulation line 20. In this manner, the plating solution circulates between the plating solution storage bath 10 and the overflow bath 12 through the plating solution circulation line 20.

The plating apparatus further includes a regulation plate 14 for regulating an electric potential distribution on the substrate W, and a paddle 16 for agitating the plating solution in the plating solution storage bath 10. The regulation plate 14 is disposed between the paddle 16 and the anode 2, and has an opening 14*a* for restricting an electric field in the plating solution. The paddle 16 is located near a surface of the substrate W held by the substrate holder 8 in the plating solution storage bath 10. A distance between the surface of the substrate W and the paddle 16 is preferably not more than 10 mm, and more preferably not more than 8 mm. The paddle 16 is made of e.g., titanium (Ti). The paddle 16 is disposed in a vertical position, and is configured to reciprocate parallel to the surface of the substrate W to thereby agitate the plating solution so that a sufficient amount of metal ions can be supplied uniformly to the surface of the substrate W during plating of the substrate W.

FIGS. 2A through 2D are schematic views showing a paddle driving device 29 configured to reciprocate the paddle 16. The paddle 16 is coupled to a crank disk 19 through a connecting rod 17. This connecting rod 17 is eccentrically coupled to the crank disk 19. When the crank disk 19 rotates in a direction indicated by arrow, the paddle 16 reciprocates parallel to the substrate W. The paddle 16 reciprocates parallel to the surface of the substrate W by the paddle driving device 29 to thereby agitate the plating solution existing near the surface of the substrate W.

Figure 3:
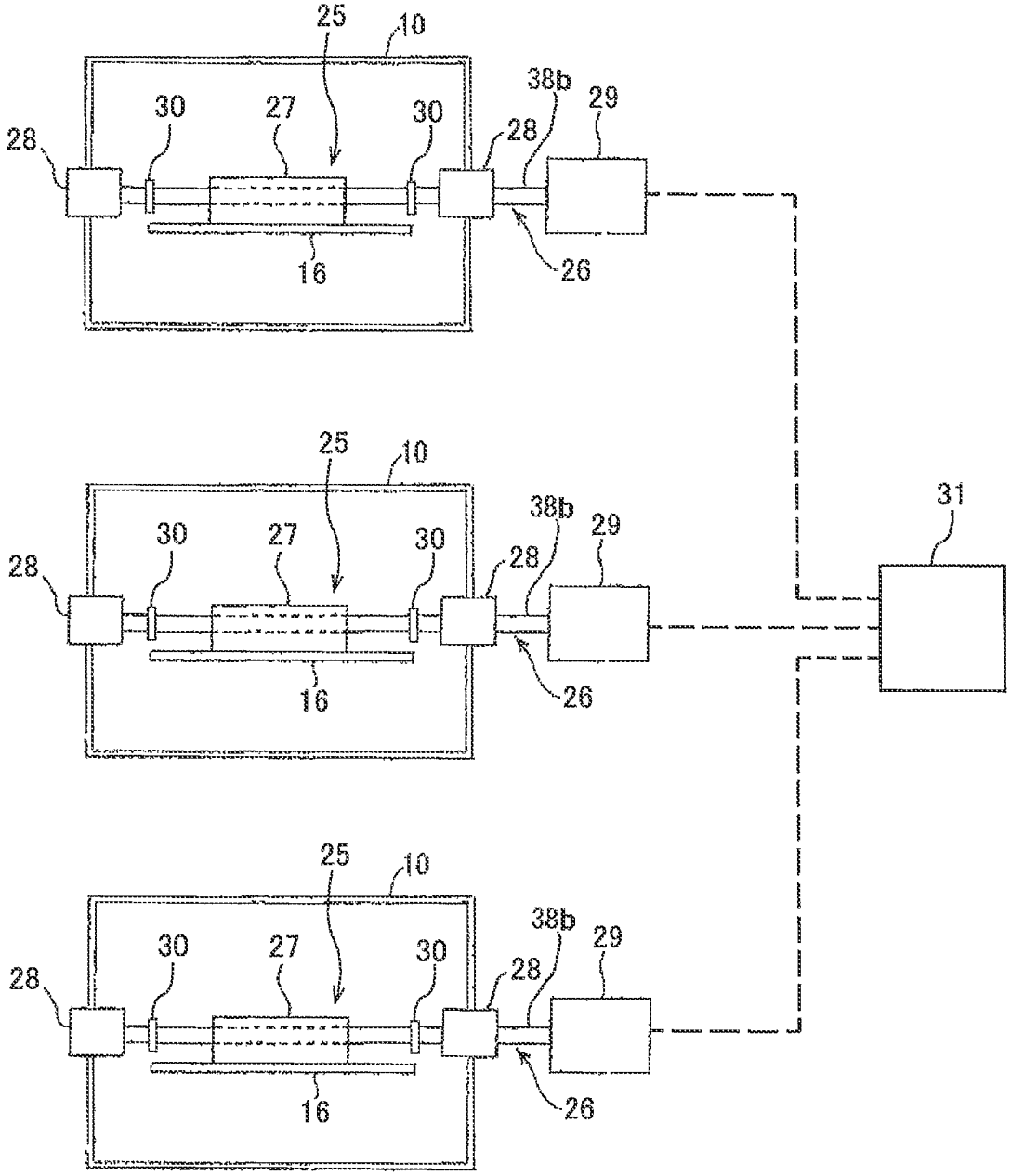
FIG. 3 is a view showing three plating solution storage baths and three paddle units.

FIG. 3 is a view showing three neighboring plating solution storage baths 10 and three paddle units 25 for driving the paddles 16. Each paddle unit 25 includes the paddle 16, a shaft 26 extending in a horizontal direction, a paddle holder 27 supporting the paddle 16, shaft supporting members 28 for supporting the shaft 26, and the above-described paddle driving device 29 for driving the paddle 16. The shaft 26 has flange portions 30 near its both ends. The flange portions 30 block the plating solution, which has adhered to the shaft 26, from reaching the shaft holders 28 through the shaft 26. A rotation of a motor of the paddle driving device 29, i.e., a reciprocation of the paddle 16, is controlled by a paddle driving controller 31. This paddle driving controller 31 is coupled to each of the paddle driving devices 29, and is configured to control the paddle driving devices 29.

When the paddles 16 in the plating solution storage baths 10 reciprocate in synchronization, the entirety of the plating apparatus may vibrate largely. Therefore, the paddle driving controller 31 controls a timing of a motor starting of each of the paddle driving devices 29 so that reciprocation phases of the paddles 16 are out of synchronization, i.e., the reciprocation phases of the paddles 16 are shifted from each other. Such a control operation of the paddle driving devices 31 can prevent the large vibration from occurring in the entirety of the plating apparatus.

Figure 4:
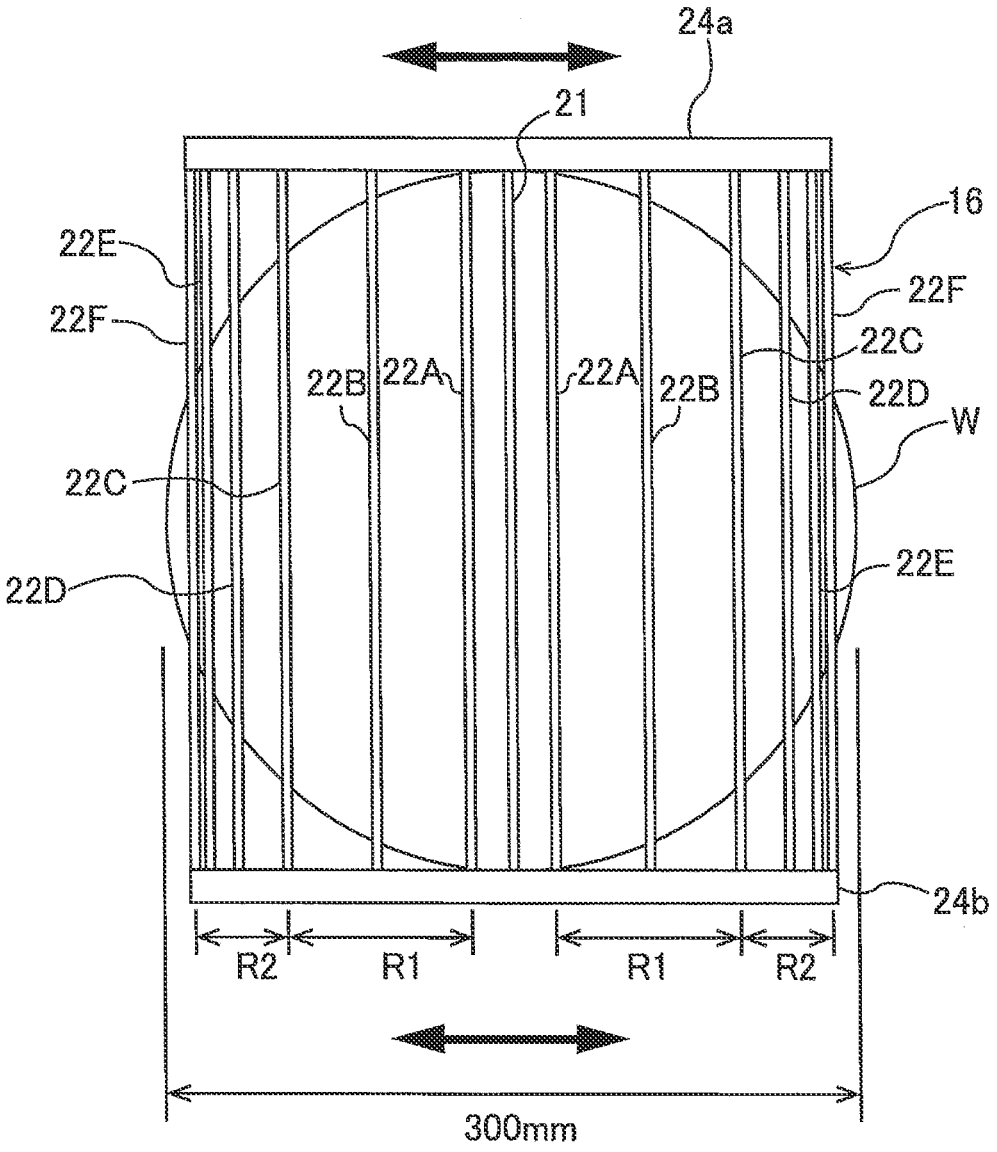
FIG. 4 is a view from arrow B shown in FIG. 1.

FIG. 4 is a view from arrow B shown in FIG. 1. In FIG. 4, the substrate holder 8 is not depicted. As shown in FIG. 4, the paddle 16 includes a central agitation rod 21 and outer agitation rods 22A to 22F extending in vertical directions, and holding elements 24*a*, 24*b* which hold these agitation rods 21, 22A to 22F. The holding element 24*a* holds upper ends of the agitation rods 21, 22A to 22F, and the holding element 24*b* holds lower ends of the agitation rods 21, 22A to 22F. The holding elements 24*a*, 24*b* extend horizontally, and are arranged parallel to the surface of the substrate W. The agitation rods 21, 22A to 22F are parallel to each other, and are parallel to the surface of the substrate W. While the paddle 16 includes thirteen agitation rods in the embodiment, the number of agitation rods is not limited to thirteen.

Figure 5:
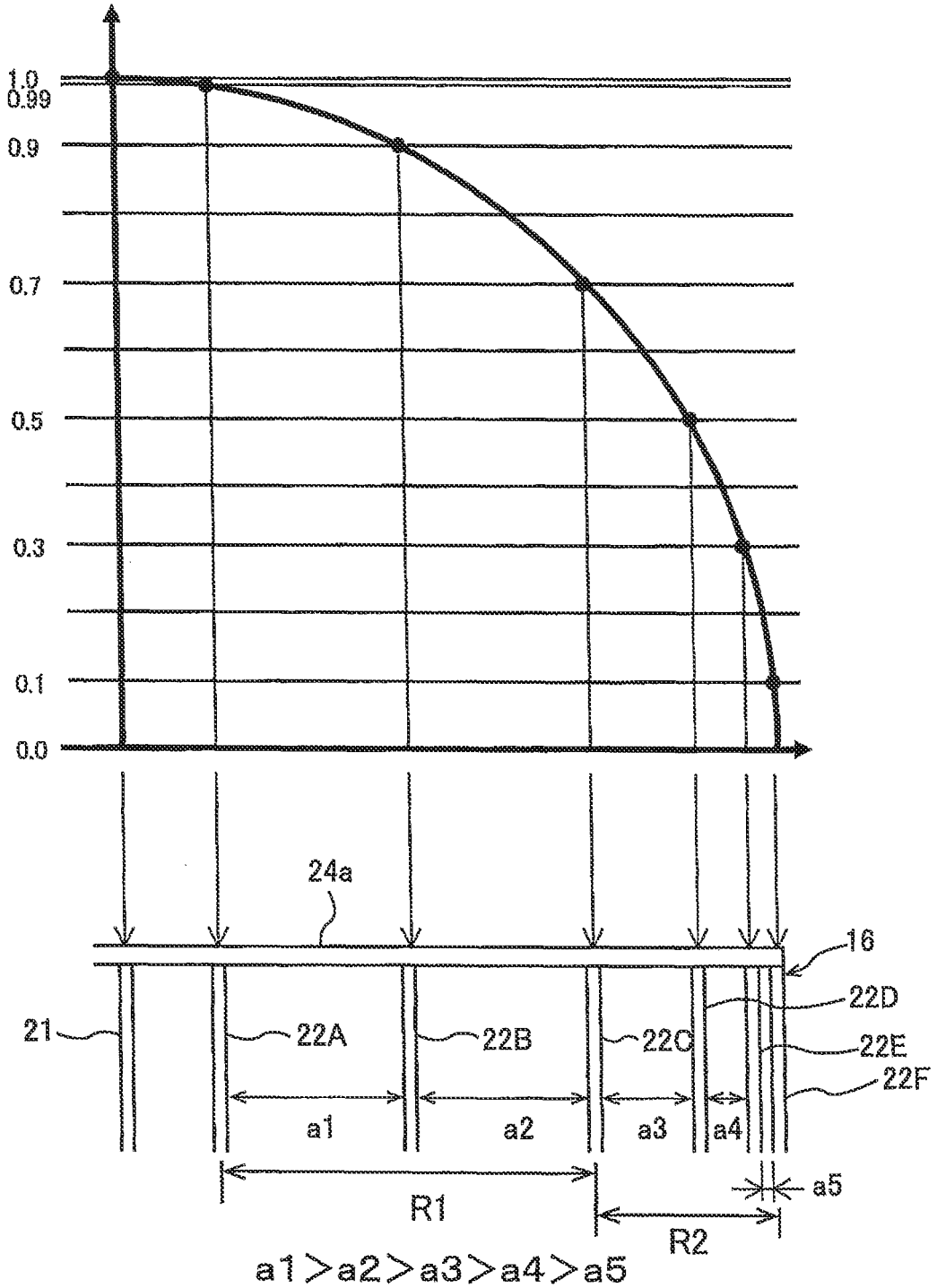
FIG. 5 is a view showing predetermined gaps between outer agitation rods.

As shown in FIGS. 4 and 5, a region from the agitation rod 22A to the agitation rod 22C is defined as an inner region R1 of the paddle 16, and a region from the agitation rod 22C to the agitation rod 22F is defined as an outer region R2 of the paddle 16. Inner regions R1 are located at both sides of the agitation rod 21 extending on a central axis of the paddle 16, and outer regions R2 are located outside the inner regions R1.

In the embodiment shown in FIG. 4, the substrate W has a diameter of 300 mm, and a width of the paddle 16 is smaller than the diameter of the substrate W. However, the diameter of the substrate W is not limited to this embodiment. Lengths of the agitation rods 21, 22A to 22F are equal to or larger than the diameter of the substrate W. In a case where a dimension of the paddle 16 satisfies a condition that a numerical value, which is obtained by subtracting a half of a stroke length of the paddle 16 from a half width of the paddle 16, is less than a radius of the substrate W, a distribution of the electric-field shielding rates on the surface of the substrate W is non-uniform. For example, in a case were the width of the paddle 16 is 280 mm, and the stroke length of the paddle 16 is 100 mm, the above numerical value, which is obtained by subtracting a half of the stroke length of the paddle 16 (i.e., 50 mm) from a half width of the paddle 16 (i.e., 140 mm), is 90 min. This numerical value is smaller than the radius (150 mm) of the substrate W. In the case where the above-described condition is met, there exists a region where the paddle 16 does not shield the substrate from the electric field at all. For example, when the reciprocating paddle 16 turns back at a left side (see FIG. 4) of the substrate W, the paddle 16 does not shield a right-side peripheral portion of the substrate W from the electric field.

The agitation rod 21, 22A to 22F are constituted by the central agitation rod 21 and the outer agitation rods 22A to 22F, and predetermined gaps are formed between the outer agitation rods 22A to 22F, respectively. These predetermined gaps are different from each other, and gradually decrease with a distance from the central agitation rod 21. The central agitation rod 21 is provided in order to prevent a sharp decrease in the electric-field shielding rate at a central portion of the substrate W. When the paddle 16 reciprocates by the action of the paddle driving device 29, a central portion of the paddle 16 moves across the central portion of the substrate W at a highest speed. Therefore, if a large gap is formed between the agitation rods in the central portion of the paddle 16, the electric-field shielding rate may drop sharply in the central portion of the substrate W. In order to prevent this, the central agitation rod 21 is provided so as to partially reduce the gap between the agitation rods in the central portion of the paddle 16. However, the central agitation rod 21 may not be necessarily provided depending on the arrangement of the outer agitation rods 22A to 22F.

FIG. 5 is a view showing the gaps between the outer agitation rods 22A to 22F. A horizontal axis of a Cartesian coordinate system shown in FIG. 5 represents the distance from the central agitation rod 21. In FIG. 5, a part of the paddle 16 is illustrated. A circular are shown in FIG. 5 is a quarter of a perfect circle having a center on the origin of the Cartesian coordinate system. As shown in FIG. 5, when the perfect circle is divided along a vertical axis at equal intervals, the perfect circle is divided unevenly along the horizontal axis. The outer agitation rods 22A to 22F are disposed at positions corresponding to positions of these uneven dividing points on the horizontal axis. That is, the outer agitation rods 22A to 22F are arranged at unequal intervals.

In the example shown in FIG. 5, a gap a1 between the outer agitation rod 22A and the outer agitation rod 22B is larger than a gap a2 between the outer agitation rod 22B and the outer agitation rod 22C. A gap a3 between the outer agitation rod 22C and the outer agitation rod 22D is smaller than the gap a2, and is larger than a gap a4 between the outer agitation rod 22D and the outer agitation rod 22E. A gap a5 between the outer agitation rod 22E and the outer agitation rod 22F is smaller than the gap a4. In this manner, the gaps between the outer agitation rods 22A to 22F gradually decrease with the distance from the central agitation rod 21 (a1>a2>a3>a4>a5).

Figure 6:
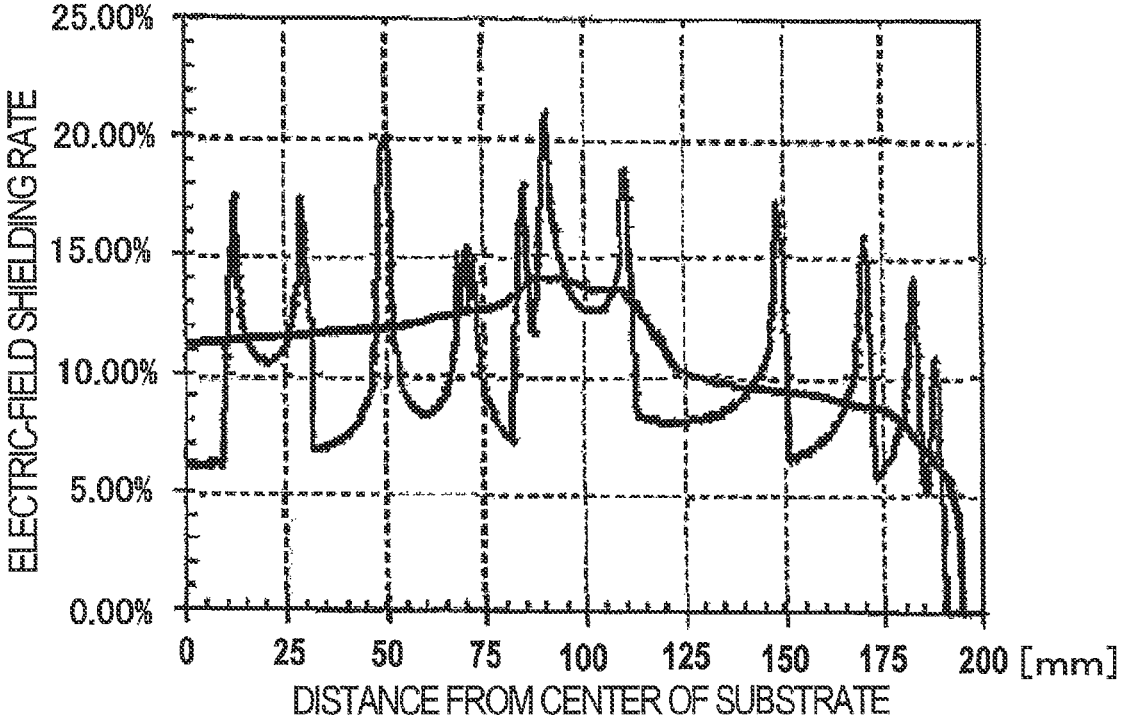
FIG. 6 is a graph showing an electric-field shielding rate obtained when using the paddle according to the embodiment.
Figure 18:
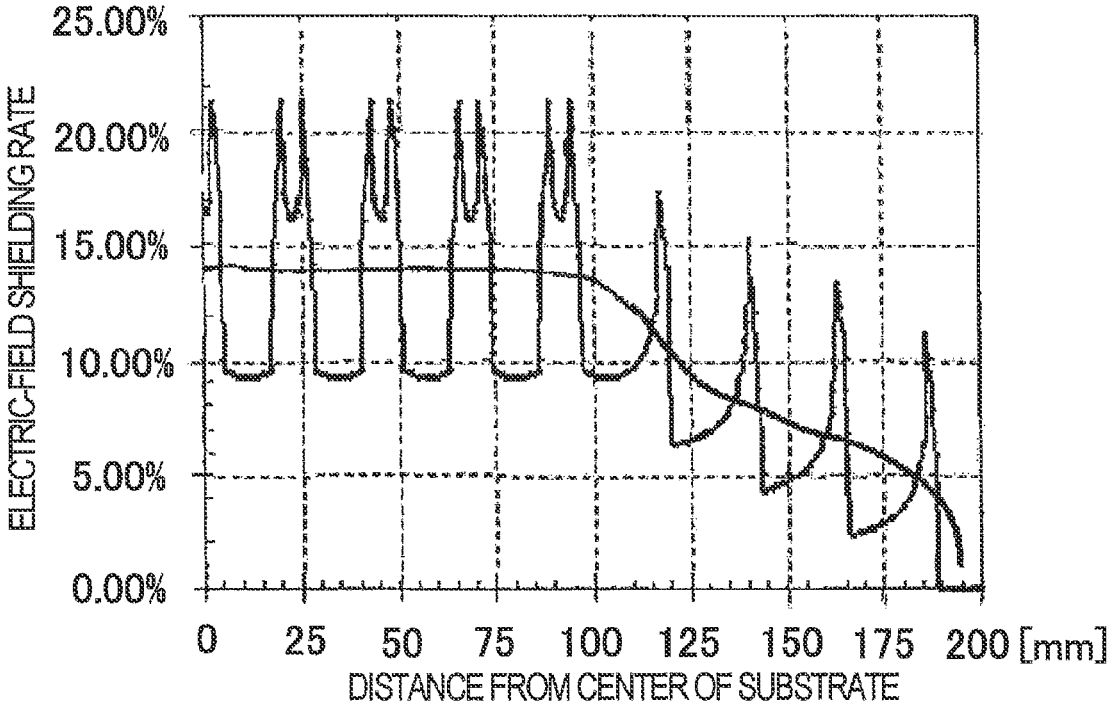
FIG. 18 is a graph showing electric-field shielding rate.

FIG. 6 is a graph showing the electric-field, shielding rate obtained when using the paddle 16 according to the embodiment. A thick line shown in FIG. 6 represents mean value of the electric-field shielding rate. A horizontal axis in FIG. 6 represents a distance [mm] from the center of the substrate W, and a vertical axis represents the electric-field shielding rate. In FIG. 6, in a region from 0 mm to 150 mm that is the distance from the enter of the substrate W, a difference between a maximum value and a minimum value of the electric-field shielding rate (the mean value) is about five points. In contrast, in FIG. 18, in a region from 0 mm to 150 mm that is the distance from the center of the substrate W, a difference between a maximum value and a minimum value of the electric-field shielding rate (the mean value) is about seven points. This shows that the use of the paddle 16 according to the embodiment can make the electric-field shielding rate uniform over the entirety of the substrate W, thus result in a uniform thickness of the metal film formed on the substrate W.

As described above, if there exists a region where the paddle 16 does not shield the substrate from the electric field at all, (e.g., if the paddle 16 does not shield the right-side peripheral portion of the substrate W from the electric field when the paddle 16 turns back at the left side of the substrate W), the electric-field shielding rate drops at the peripheral portion of the substrate W. Thus, as shown in FIG. 5, the gaps a3 to a5 between the agitation rods 22C to 22F disposed in the outer region R2 of the paddle 16 are smaller than the gaps a1 and a2 between the agitation rods 22A to 22C disposed in the inner region R1 of the paddle 16. Since a density of the agitation rods in the outer region R2 of the paddle 16 is higher than a density of the agitation rods in the inner region R1, the drop in the electric-field shielding rate at the peripheral portion of the substrate W can be prevented.

Figure 7:
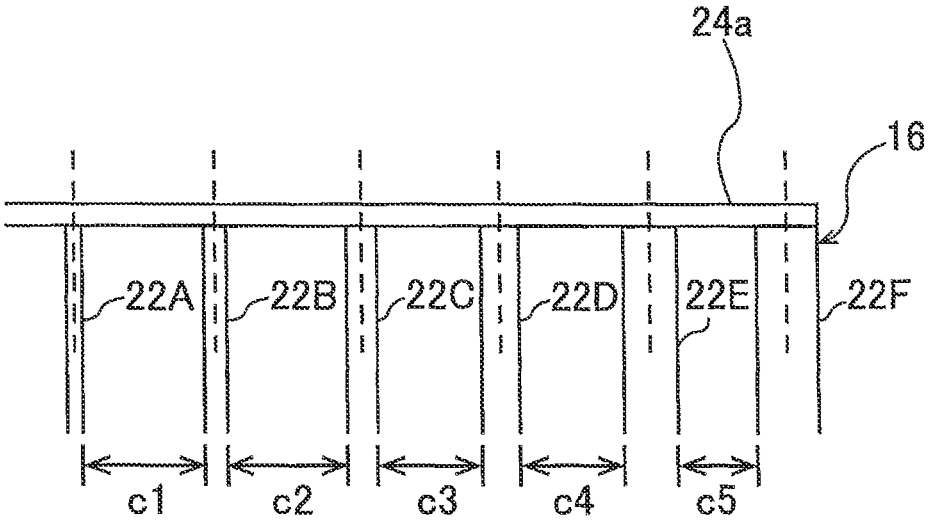
FIG. 7 is a view showing a modified example of the paddle.

FIG. 7 is a view showing a modified example of the paddle 16. A part of the paddle 16 is depicted in FIG. 7. The outer agitation rods 22A to 22F shown in FIG. 7 are arranged at equal intervals, while the outer agitation rods 22A to 22F have different widths. Specifically, the widths of the agitation rods 22A to 22F gradually increase with the distance from the central agitation rod 21. As a result, the gaps between the outer agitation rods 22A to 22F gradually decrease with the distance from the central agitation rod 21.

In FIG. 7, a gap c1 between the outer agitation rod 22A and the outer agitation rod 22B is larger than a gap c2 between the outer agitation rod 22B and the outer agitation rod 22C. A gap c3 between the outer agitation rod 22C and the outer agitation rod 22D is smaller than the gap c2, and is larger than a gap c4 between the outer agitation rod 22D and the outer agitation rod 22E. A gap c5 between the outer agitation rod 22E and the outer agitation rod 22F is smaller than the gap c4 (c1>c2>c3>c4>c5).

In this manner, since the widths of the outer agitation rods 22A to 22F gradually increase with the distance from the central agitation rod 21, the gaps c1 to c5 between the outer agitation rods 22A to 22F gradually decrease with the distance from the central agitation rod 21. The use of the paddle 16 having such configurations can make the electric-field shielding rate uniform over the entirety of the substrate W, thus result in a uniform thickness of the metal film formed on the substrate W.

Figure 8:
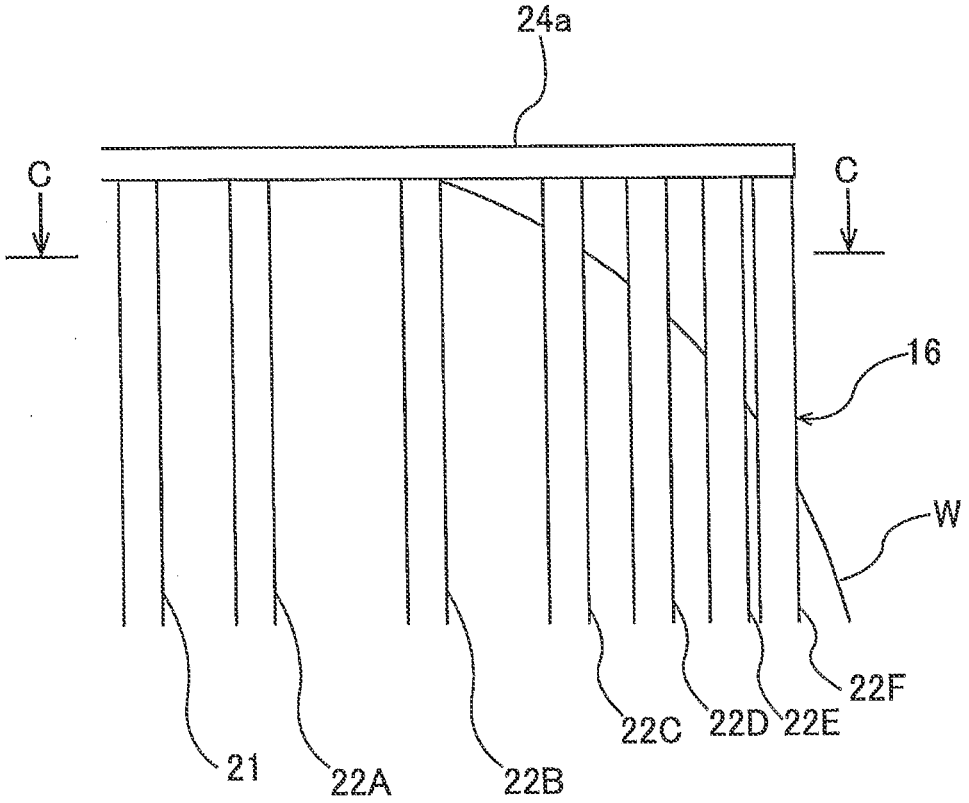
FIG. 8 is a view showing another modified example of the paddle.
Figure 9:
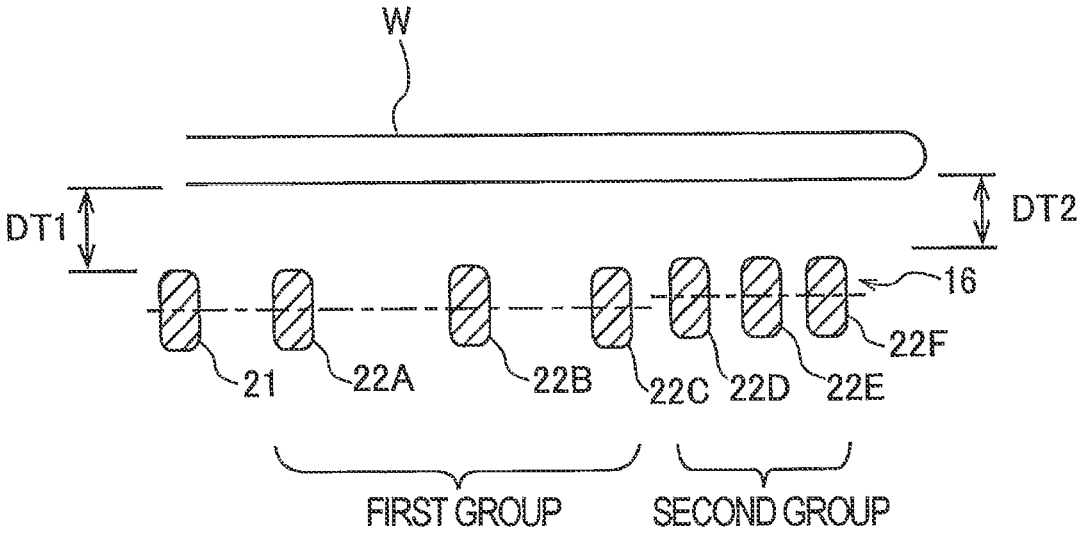
FIG. 9 is a cross-sectional view taken along line C-C in Ha 8.

FIG. 8 is a view showing another modified example of the paddle 16, and FIG. 9 is a cross-sectional view taken along line C-C in FIG. 8. The embodiment shown in FIG. 8 is the same as the above-described embodiment in that the gaps between the outer agitation rods 22A to 22F gradually decrease with the distance from the central agitation rod 21. The outer agitation rods 22A to 22F have the same width. As shown in FIG. 9, each of the central agitation rod 21 and the agitation rods 22A to 22F has approximately a rectangular horizontal section. In the examples shown in FIG. 8 and FIG. 9, the outer agitation rods 22A to 22F are divided into a first group located, at both sides of the central agitation rod 21 and a second group located outside the first group.

Figure 10:
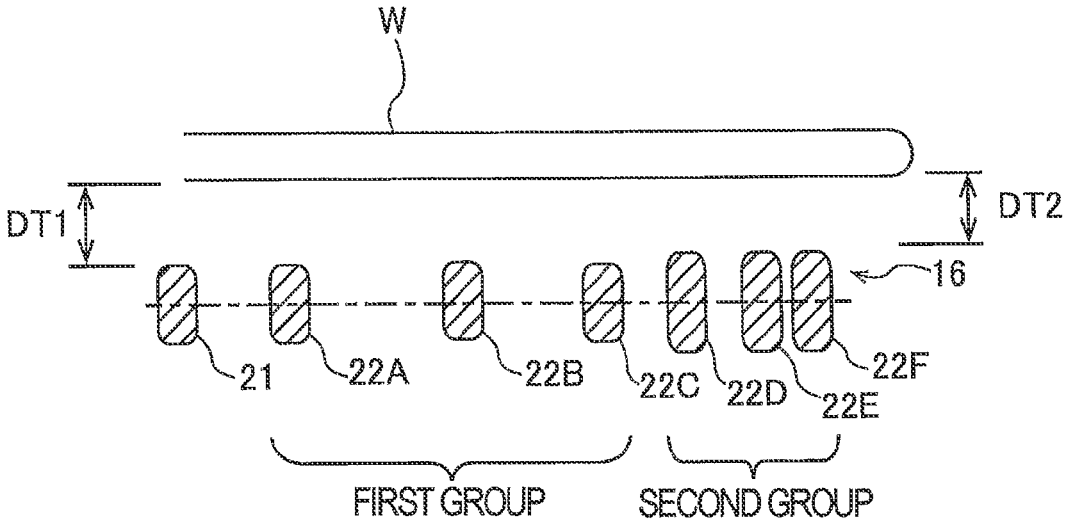
FIG. 10 is a view showing still another modified example of the paddle.

A distance DT2 between the surface of the substrate W and the outer agitation rods 22D to 22F belonging to the second group is smaller than a distance DT1 between the surface of the substrate W and the outer agitation rods 22A to 22C belonging to the first group. The distance DT1 and the distance DT2 are preset distances. As shown in FIG. 10, a depth of the outer agitation rods 22D to 22F belonging to the second group may increase in a direction closer to the substrate W. As shown in FIG. 9 and FIG. 10, since the outer agitation rods 22D to 22F belonging to the second group are closer to the surface of the substrate W than the outer agitation rods 22A to 22C belonging to the first group, an agitating force can be improved at the peripheral portion of the substrate W at which the plating solution is apt to stagnate.

Figure 11:
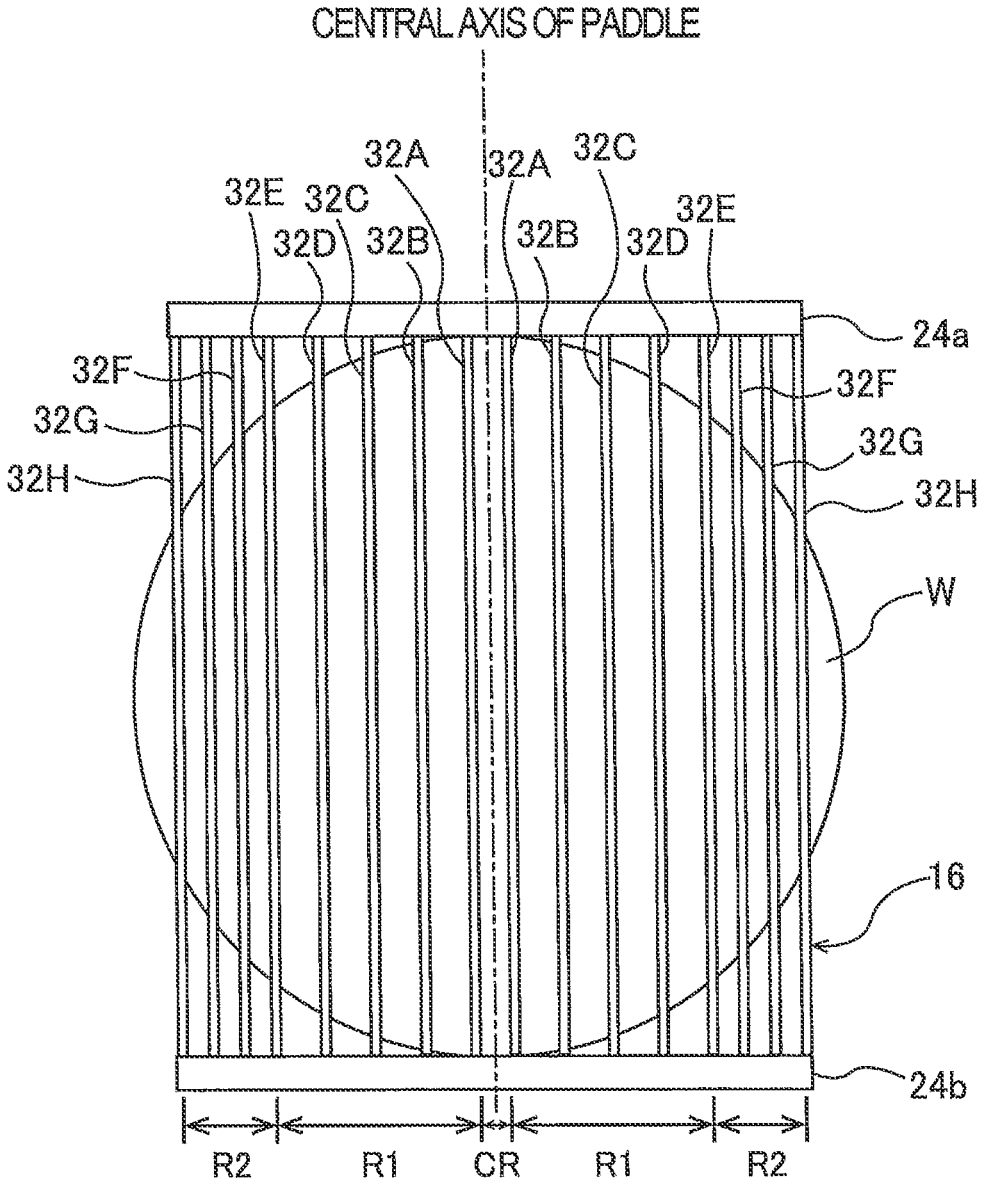
FIG. 11 is a view showing the paddle according to another embodiment.

FIG. 11 is a view showing the paddle 16 according to another embodiment. The paddle 16 shown in FIG. 11 does not have the central agitation rod 21, unlike the paddle 16 shown in FIG. 4. The paddle 16 has a central opening region CR where no agitation rod is disposed. This central opening region CR extends on the central axis of the paddle 16. The inner regions R1 are located at both sides of the central opening region CR, and the outer regions R2 are located outside the inner regions R1. In this embodiment, the paddle 16 has agitation rods 32A to 32H. The number of agitation rods 21, 22A to 22F shown in FIG. 4 is 13 (odd number), whereas the number of agitation rods 32A to 32H according to this embodiment is 16 (even number).

Figure 12:
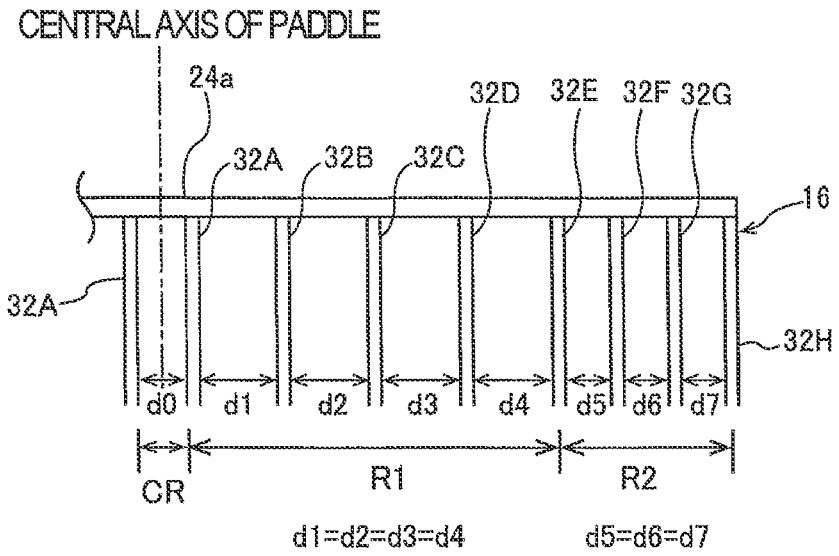
FIG. 12 is a view showing gaps between agitation rods arranged in an inner region and gaps between the agitation rods arranged in an outer region.

FIG. 12 is a view showing gaps d1 to d4 between the agitation rods 32A to 32E disposed in the inner region R1 and gaps d5 to d7 between the agitation rods 32E to 32H disposed in the outer region R2. The gaps d5 to d7 between the agitation rods 32E to 32H disposed in the outer region R2 of the paddle 16 are the same as each other. The gaps d1 to d4 between the agitation rods 32A to 32E disposed in the inner region R1 are also the same as each other. The agitation rod 32E is located at a boundary between the inner region R1 and the outer region R2. The central opening region CR is formed by a gap between two agitation rods 32A, 32A. Which are closest to the central axis of the paddle 16, of the agitation rods 32A to 32E disposed in the inner regions R1.

The gaps d5 to d7 between the agitation rods 32E to 32H are smaller than the gaps d1 to d4 between the agitation rods 32A to 32E. Therefore, as with the embodiment shown in FIG. 4 and FIG. 5, the arrangement in this embodiment can prevent the drop in the electric-field shielding rate at the peripheral portion of the substrate W, and can form a metal film with a uniform thickness on the substrate W. A width d0 of the central opening region CR is smaller than the gaps d1 to d4 between the agitation rods 32A to 32E disposed in the inner regions R1, so that the sharp drop in the electric-field shielding rate at the center of the substrate W is prevented.

The embodiments shown in FIG. 7 through FIG. 10 can be applied to the embodiments shown in FIG. 11 and FIG. 12. For example, widths of the agitation rods 32F to 32H disposed in the outer regions R2 may be larger than those of the agitation rods 32A to 32D disposed in the inner regions R1. The distance of the agitation rods 32F to 32H disposed in the outer regions R2 from the surface of the substrate W may be smaller than the distance of the agitation rods 32A to 32D disposed in the inner regions R1 from the surface of the substrate W.

The above-discussed embodiments shown in FIG. 4 through FIG. 10 are directed to a configuration in which the central agitation rod 21 is provided so as to partially reduce the gap between the agitation rods in the central portion of the paddle 16. The above-discussed embodiments shown in FIG. 11 and FIG. 12 are directed to a configuration in which the width d0 of the central opening region CR is smaller than the gaps d1 to d4 between the agitation rods 32A to 32E disposed in the inner regions R1. The purpose of these configurations is to prevent the sharp drop in the electric-field shielding rate at the central portion of the substrate W where the paddle 16 moves at high speed. The configuration in which the gap between the agitation rods in the central portion of the paddle 16 is smaller than the gaps between the agitation rods disposed at the both sides of the central agitation rods is not limited to those shown in FIG. 4 and FIG. 11.

Figure 13:
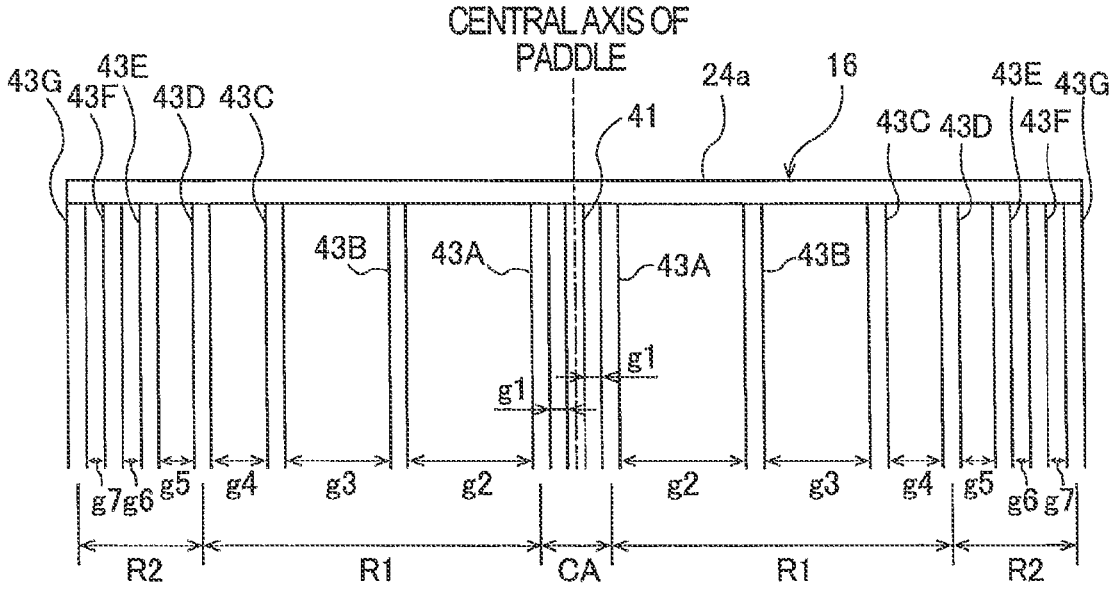
FIG. 13 is a view showing still another embodiment of the paddle in which a gap between agitation rods in a central region is smaller than gaps between agitation rods arranged at both sides of the central region.
Figure 14:
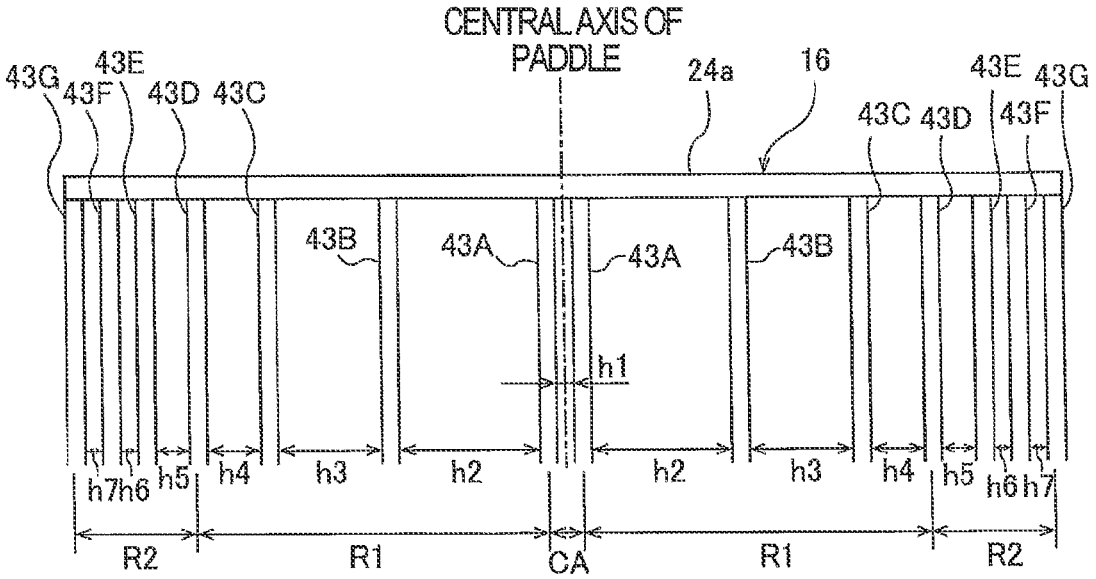
FIG. 14 is a view showing still another embodiment of the paddle in which a gap between agitation rods in a central region is smaller than gaps between agitation rods arranged at both sides of the central region.
Figure 15:
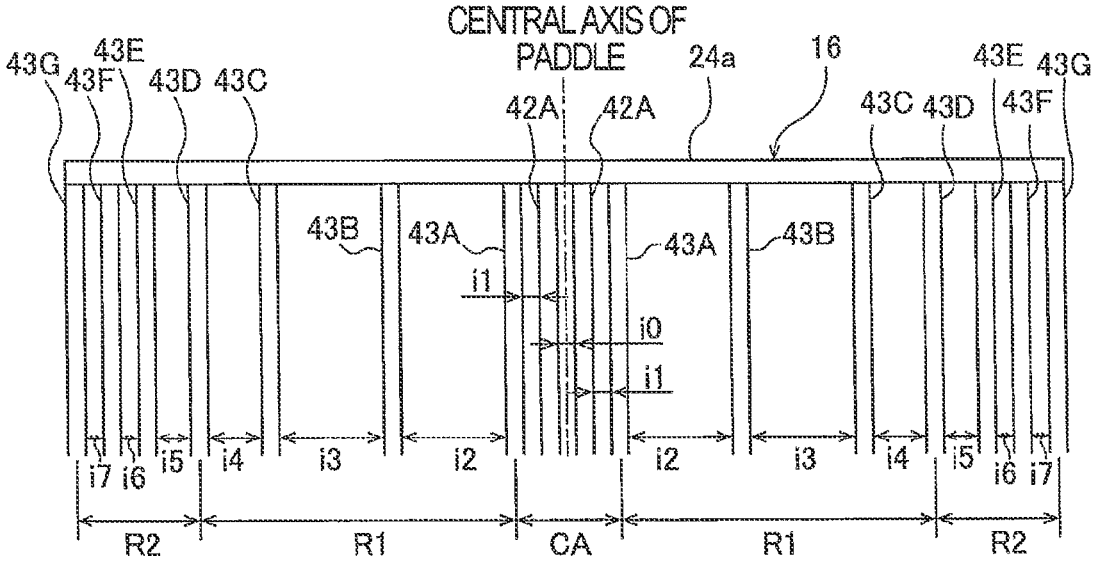
FIG. 15 is a view showing still another embodiment of the paddle in which a gap between agitation rods in a central region is smaller than gaps between agitation rods arranged at both sides of the central region.
Figure 16:
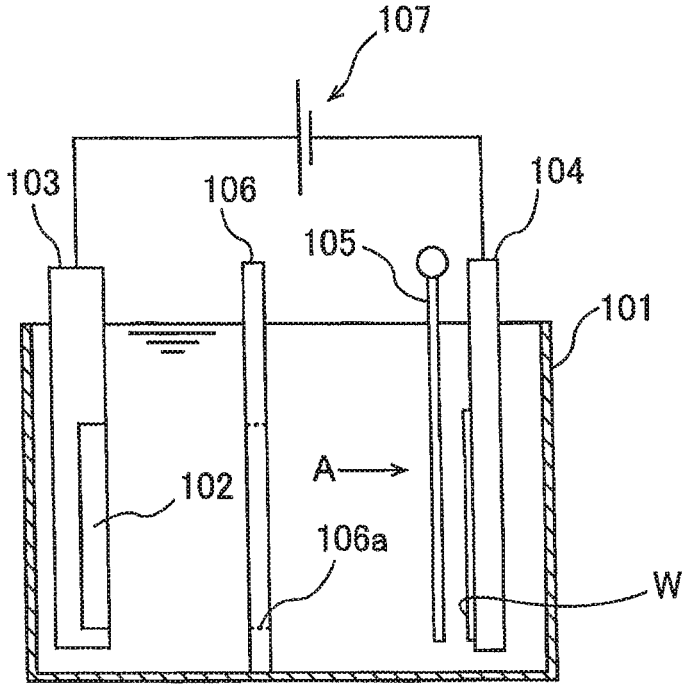
FIG. 16 PRIOR ART
FIG. 16 is a schematic view showing a plating apparatus.
Figure 17:
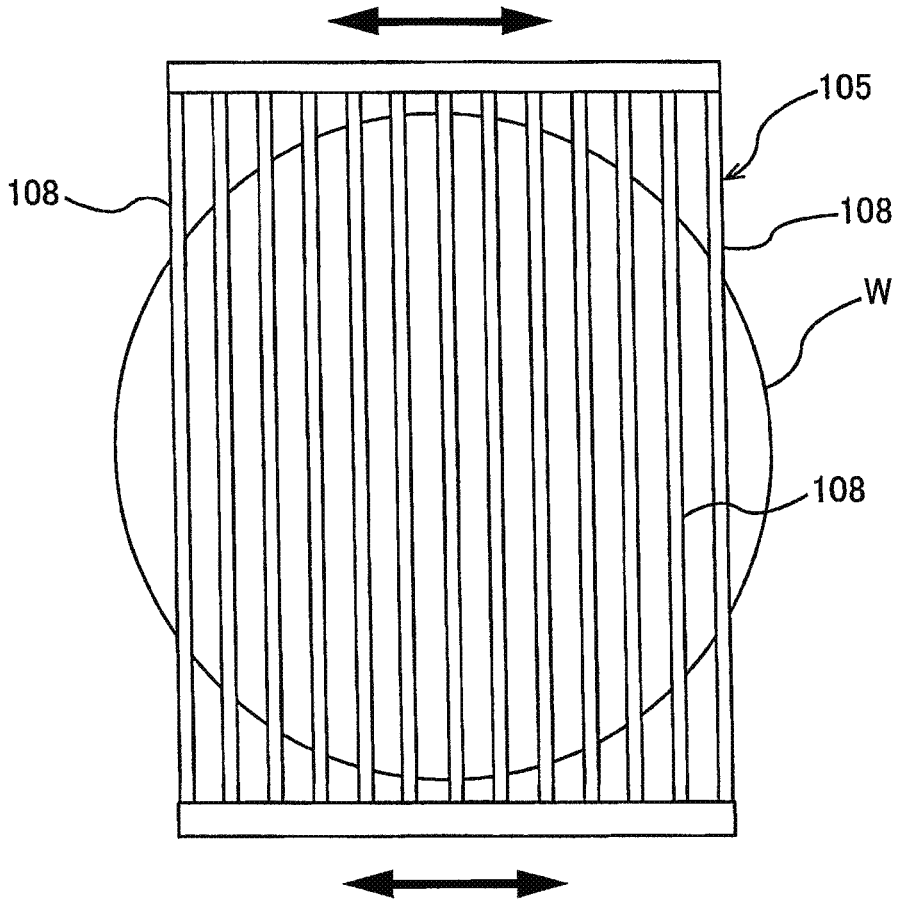
FIG. 17 PRIOR ART
FIG. 17 is a view from arrow A shown in FIG. 16.

FIG. 13 through FIG. 15 are views each showing still another embodiment of the paddle 16 in which a gap between agitation rods in a central region CA of the paddle 16 is smaller than gaps between agitation rods disposed at the both sides of the central region CA. In FIG. 13 through FIG. 15, only an upper part of the paddle 16 is depicted. In the embodiment shown in FIG. 13, the paddle 16 includes a central agitation rod 41, extending on the central axis of the paddle 16, and agitation rods 43A to 43G. The central region CA is formed by three agitation rods, i.e., the central agitation rod 41 and the agitation rods 43A, 43A arranged at both sides of the central agitation rod 41. The inner regions R1 are located at both sides of the central region CA, and the outer regions R2 are located outside the inner regions R1. Two gaps g1, g1 (i.e., gaps g1, g1 on both sides of the central agitation rod 41) are formed between the central agitation rod 41 and two agitation rods 43A, 43A located at the both sides of the central agitation rod 41.

The agitation rods 43A are located at boundaries between the central region CA and the inner regions R1, and the agitation rods 43D are located at boundaries between the inner regions R1 and the outer regions R2. Gaps g2 to g4 are formed between the agitation rods 43A to 43D disposed in the inner regions R1, and gaps g5 to g7 are formed between the agitation rods 431) to 43G disposed in the outer regions R2. The gaps g1, g1 formed in the central region CA are smaller than the gaps g2 to g4 formed in the inner regions R1.

In the embodiment shown in FIG. 14, the paddle 16 does not have the central agitation rod 41. The central region CA is formed by two agitation rods 43A, 43A disposed at the both sides of the central axis of the paddle 16. A gap h1 is formed between these agitation rods 43A, 43A. The gap h1 extends on the central axis of the paddle 16. The agitation rods 43A are located at the boundaries between the central region CA and the inner regions R1, and the agitation rods 43D are located at the boundaries between the inner regions R1 and the outer regions R2. Gaps h2 to h4 are formed between the agitation rods 43A to 43D disposed in the inner regions R1, and gaps h5 to h7 are formed between the agitation rods 43D to 43G disposed in the outer regions R2. The gap h1 formed in the central region CA is smaller than the gaps h2 to h4 buried in the inner regions R1.

In FIG. 15, the central region CA is formed by four agitation rods, i.e., the agitation rods 42A, 42A and the agitation rods 43A, 43A. The agitation rods 42A, 42A are disposed at the both sides of the central axis of the paddle 16, and the agitation rods 43A, 43A are disposed outside the agitation rods 42A, 42A. A gap i0, extending on the central axis of the paddle 16, and gaps i1, i1, formed at the both sides of the gap i0, are formed in the central region CA. The gap i0 is formed between the agitation rods 42A, 42A, and the gaps i1, i1 are formed between the agitation rods 42A, 42A and the agitation rods 43A, 43A.

Gaps i2 to i4 are formed between the agitation rods 43A to 43D disposed in the inner regions R1. Gaps i5 to i7 are formed between the agitation rods 43D to 43G disposed in the outer regions R2. The agitation rods 43A are located at the boundaries between the central region CA and the inner regions R1, and the agitation rods 43D are located at the boundaries between the inner regions R1 and the outer regions R2. The gap i0 and the gaps i1, i1 formed in the central region CA are smaller than the gaps i2 to i4 formed in the inner regions R1.

In all of the embodiments shown in FIG. 13 through FIG. 15, the gap between the agitation rods in the central region CA is smaller than the gaps between the agitation rods in the regions (i.e., the inner regions R1) at both sides of the central region CA. The number of agitation rods disposed in the central region CA is arbitrarily determined. Further, whether the agitation rod is disposed on the central axis of the paddle 16 or the gap is formed on the central axis of the paddle 16 is arbitrarily selected. The gaps between the agitation rods in the inner regions R1 located outside the central region CA are larger than the gap(s) between the agitation rods in the central region CA. The gaps between the agitation rods in the outer regions R2 located outside the inner regions R1 are smaller than the gaps between the agitation rods in the inner regions R1.

Since the gaps between the agitation rods in the outer regions R2 are smaller than the gaps between the agitation rods in the inner regions R1, the decrease in the electric-field shielding rate at the peripheral portion of the substrate W can be prevented. Further, since the gap between the agitation rods in the central region CA is smaller than the gaps between the agitation rods in the inner regions R1, the sharp drop in the electric-field shielding rate at the central portion of the substrate W can be prevented.

Although the embodiments of the present invention have been described above, it should be understood that the present invention is not limited to the above embodiments, and various changes and modifications may be made without departing from the technical concept of the present invention. Expressions of the outer region and the inner region of the paddle are terms that indicate a relative positional relationship, and the above-discussed embodiments are not intended to limit an absolute positional relationship.

Further, while the agitation rods of the paddle 16 are bilaterally symmetric with respect to the central axis of the paddle 16 in the above-discussed embodiments, the agitation rods may not be bilaterally symmetric. Moreover, while the above-described embodiments are directed to an electrolytic plating apparatus, the present invention can be applied to an apparatus for processing a substrate by an electrolytic action. For example, the present invention may be applied to an electrolytic etching apparatus. In the substrate electrolytic processing apparatus having a processing bath, such as an electrolytic etching bath, in which a substrate and a counter electrode are disposed, the use of the paddle 16 according to the embodiments can reduce an influence of the electric field shielding by the paddle 16 on a uniformity of processing.

What is claimed is:

1. An apparatus for plating a substrate, comprising:

a processing bath for holding a processing solution;

a substrate holder for holding a substrate and capable of locating the substrate in the processing bath;

a counter electrode disposed in the processing bath and serving as an electrode opposite to the substrate; and a paddle disposed between the counter electrode and the substrate and configured to reciprocate parallel to a surface of the substrate so as to agitate the processing solution, the paddle including agitation rods disposed in an inner region of the paddle and agitation rods disposed in an outer region of the paddle, and gaps between the agitation rods disposed in the outer region being smaller than gaps between the agitation rods disposed in the inner region, the paddle having a width smaller than a width of the substrate, wherein a numerical value, which is obtained by subtracting a half of a stroke length of the paddle from a half width of the paddle, is less than the width of the substrate, and a central region is formed at a center of the paddle, and a gap between agitation rods disposed in the central region is smaller than the gaps between the agitation rods disposed in the inner region.

2. The apparatus according to claim 1, wherein an agitation rod is disposed on a central axis of the paddle.

3. The apparatus according to claim 1, wherein the gaps between the agitation rods disposed in the inner region are the same as each other.

4. The apparatus according to claim 1, wherein the gaps between the agitation rods disposed in the outer region are the same as each other.

5. The apparatus according to claim 1, wherein the agitation rods are divided into a first group and a second group which is located outside the first group, and a distance between the second group and the surface of the substrate is smaller than a distance between the first group and the surface of the substrate.

* * * * *